United States Patent [19]

Clark

[11] Patent Number: 4,843,825

[45] Date of Patent: Jul. 4, 1989

[54] COMBUSTOR DOME HEAT SHIELD

[75] Inventor: Jim A. Clark, Jupiter, Fla.

[73] Assignee: United Technologies Corporation, Hartford, Conn.

[21] Appl. No.: 194,354

[22] Filed: May 16, 1988

[51] Int. Cl.[4] ..... F23R 3/50; F23R 3/14

[52] U.S. Cl. ..... 60/756; 60/39.37

[58] Field of Search ..... 60/756, 757, 752, 39.141, 60/755, 759, 747, 39.37

[56] References Cited

U.S. PATENT DOCUMENTS

| | | | |
|---|---|---|---|
| 2,768,497 | 10/1956 | Hayes | 60/756 |
| 4,085,581 | 4/1978 | Carvel et al. | 60/756 |
| 4,180,974 | 1/1980 | Stenger et al. | 60/756 |
| 4,222,230 | 9/1980 | Bobo et al. | 60/756 |
| 4,356,693 | 11/1982 | Jeffery et al. | 60/39.37 |
| 4,567,730 | 2/1986 | Scott | 60/757 |

FOREIGN PATENT DOCUMENTS

| | | | |
|---|---|---|---|
| 994115 | 8/1976 | Canada | 60/756 |

*Primary Examiner*—Louis J. Casaregola
*Assistant Examiner*—Timothy S. Thorpe
*Attorney, Agent, or Firm*—Edward L. Kochey, Jr.

[57] ABSTRACT

An annular combustor has a plurality of fuel injectors 14, each supporting a heat shield 30. Each shield has an overlap portion 42 deflecting cooling air passing between the shields, thereby avoiding a curtain of air between the flames of adjacent fuel injectors.

6 Claims, 3 Drawing Sheets

COMBUSTOR DOME HEAT SHIELD

TECHNICAL FIELD

The invention relates to gas turbine engine combustors and in particular to annular combustors.

BACKGROUND OF THE INVENTION

Fuel combustion and gas turbine engine combustors encounters many design problems when attempting to achieve optimum engine operation. High temperatures create material strength and longevity problems and also create thermal expansion problems. Smokeless combustion must be achieved with high efficiency. The flame must be easily ignited and stable against flameout at fuel lean conditions.

In an annular combustor, an annular dome supports the plurality of fuel nozzles in a circumferentially spaced manner. A cooled heat shield is interposed between the dome and the combustion chamber. Continuous annular shields have given way to segmented shields in modern high temperature combustors because of expansion and buckling of the continuous shields. With the segmented shields, one segment is secured to each fuel nozzle with the segments substantially abutting one another when hot. The segments, however, have a gap between adjacent segments when operating at lower temperatures.

When operating at the lower loading with fuel lean mixtures the cooling air passing between the spaced shields creates a curtain effect between adjacent nozzle flames. This limits the ability of adjacent flames to support the ignition of their neighbors and accordingly leads to poor ignitability and a tendency for early flameout.

SUMMARY OF THE INVENTION

An annular combustor has a plurality of circumferentially spaced fuel injectors introducing fuel and air to the combustion chamber in a swirl around the axis of each of the injectors. The injectors are supported on an annular support dome through which secondary air passes. A plurality of circumferentially spaced heat shields are supported on the fuel injectors and interposed between the dome structure and the combustion chamber. Each of the shields has an overlap portion which axially overlaps an adjacent heat shield. Accordingly, secondary air passing between the heat shields is deflected away from the axial direction toward the circumferential direction.

An ignitor is located on either the inner or outer wall of the annular combustor. The overlap portion if used only on one radial side of the ignitors is preferably located on the side containing the ignitor.

DESCRIPTION OF THE PREFERRED EMBODIMENT

Figure 1:
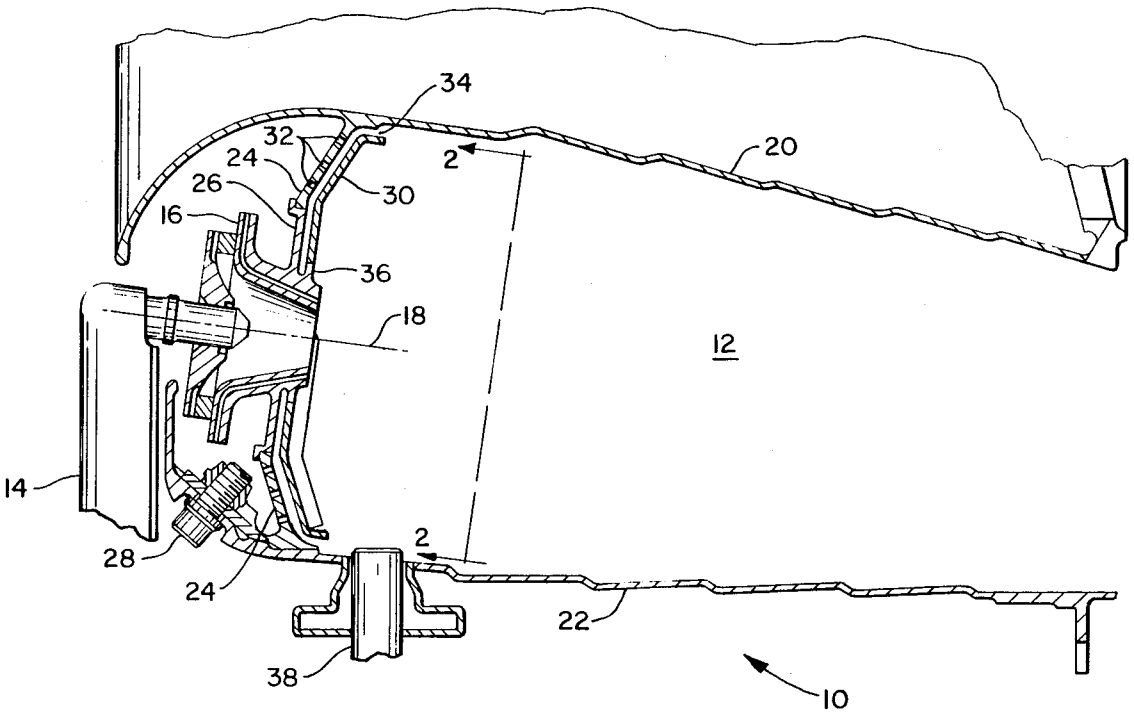
FIG. 1 is a sectional view through the annular combustor.

The annular combustor 10 includes a toroidal or annular combustion chamber 12 into which fuel is injected by fuel injectors 14. The fuel injector assembly includes also a primary air delivery swirler 16 so that primary air and fuel are delivered in a swirling manner around the axis 18 of each fuel nozzle.

The combustor has an inner circumference 20 and an outer circumference 22. An annular support dome structure 24 is secured to the inner circumference 20. Each fuel nozzle air swirler 16 has integrally secured thereto a dome attachment structure 26, each of which fits into an opening in the dome 24. The outer circumference 22 is secured at a later time to the dome by bolts 28.

A plurality of heat shields 30 are secured to air swirler 16 and interposed between combustion chamber 12 and the support dome 24. A plurality of holes 32 permit secondary air to pass through the dome structure impinging against the surface of heat shield 30 for cooling purposes. The majority of this cooling air exits through openings 34 near the inner and outer circumferences of the combustor. The air nozzle 16 has heat shield stubs 36 to which the heat shields 30 are welded during assembly.

At least one ignitor 38 is supplied and as shown here is located on the outer circumference 22 of the combustor.

Figure 2:
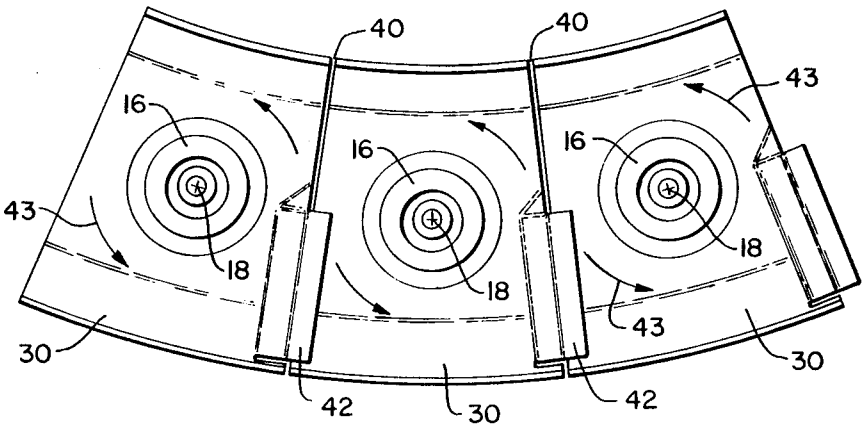
FIG. 2 is an elevation section showing the heat shields.

FIG. 2 is a sectional elevation view showing arrangement of three heat shields 30. Each of these shields is secured to air swirler 16 and installed with a slight gap 40 between adjacent heat shields when at room temperature. Each heat shield has an overlap portion 42 which axially overlaps a portion of an adjacent heat shield. Air passing between adjacent heat shields 30 at the outer half of the annular chamber is deflected by overlap portions 42 in a counterclockwise direction 43 around the entire combustion chamber and also with respect to the individual fuel nozzles 18. This is the same direction as the swirl being imposed by the fuel nozzle and swirler 16.

At low loading when the gap between adjacent heat shields exists, the overlap avoids an axial introduction of cooling air which would interpose a curtain between adjacent fuel nozzles. The deflection of incoming secondary air is such that it passes along the surface of heat shield 30. While this does improve the cooling effect of the heat shield, its primary purpose is to avoid the axial airflow between flames from adjacent fuel injectors.

As illustrated in FIG. 2, this overlap portion 14 exists only on one side of the plurality of fuel nozzles. This simplifies installation, since overlaps on both sides of the nozzle in the direction of swirl around the fuel nozzle would create heat shield installation difficulties.

Figure 3:
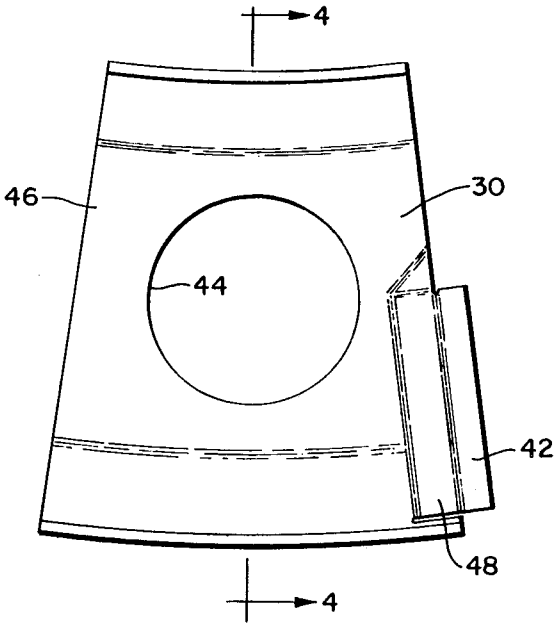
FIG. 3 is a detail of a heat shield before installation.
Figure 4:
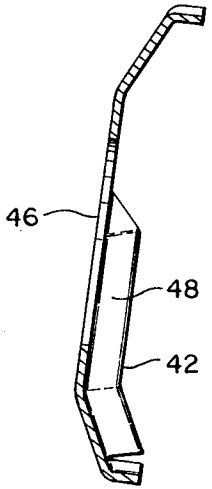
FIG. 4 is a section through FIG. 3.

FIGS. 3 and 4 illustrate the individual shield 30 in more detail. The central opening 44 of the heat shield is sized to be welded to stub 36 of the primary air swirler. A substantially planar portion 46 of the heat shield performs the primary heat shielding function extending throughout the arcuate segment The overlap portion 42 is formed by stamping an angled section 48 from the flat portion 46 to carry and align the overlap portion 42. This portion 42 is parallel with plate 46 and accordingly overlaps an adjacent plate in a parallel manner.

It is noted that the gaps 40 between adjacent shield segments close in accordance with the prior art structure at high thermal loading. The portion without the overlap also does here. With the overlap portion the gap will not close where the overlap portion exists. However, this airflow is not detrimental to the combustion operation and continues to supply cooling air to the shields at this high temperature condition. On the other hand, at low loading conditions where avoiding flameout and ease of ignitability are significant factors, the overlap portion avoids the establishment of a curtain of air separating flames from adjacent fuel injectors. Tests comparing the prior art gap structure with the overlap on the outer radial portion only of the heat shields have shown that with a given air flow, fuel flow can be reduced to $\frac{2}{3}$ of the original value without experiencing flameout. Fuel required for ignition is reduced the same amount.

Figure 5:
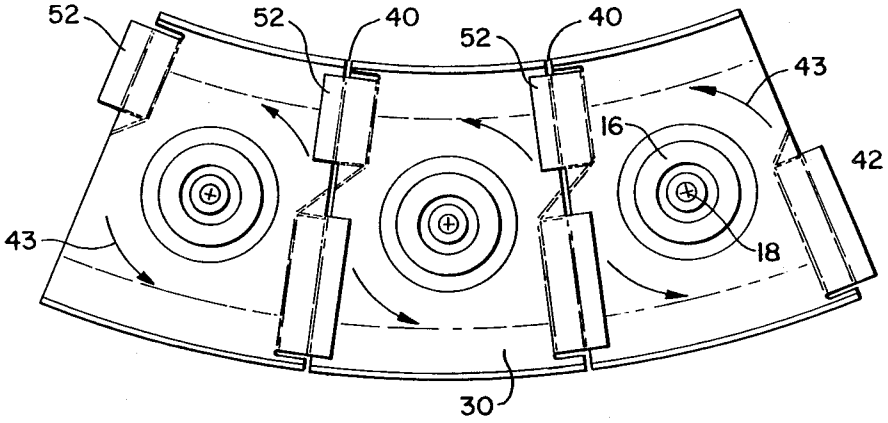
FIG. 5 is an elevation section showing an alternate heat shield.

FIG. 5 illustrates an alternate embodiment having an addition to overlap portion 42 another overlap portion 52 located radially inwardly of the fuel nozzles. While this configuration has not been tested in accordance with the inventive concept, this would further improve the fuel lean operating conditions because of avoiding air flow through gap 40. As described above, the double overlap concept creates a problem in installing the last shield. Accordingly, the overlap portion 52 on the last shield must be welded in place after installation.

I claim:

1. An annular combustor for a gas turbine engine comprising:

an annular combustion chamber having an inner circumference and an outer circumference;

a plurality of circumferentially spaced fuel injectors in said combustion chamber;

swirl means for introducing fuel and primary air to said combustion chamber in a swirl around the axis of each of said injectors;

at least one ignitor extending from one circumference of said combustion chamber;

an annular support dome structure for supporting said plurality of fuel injectors and for passing secondary air therethrough;

a plurality of circumferentially spaced heat shields interposed between said dome structure and said combustion chamber, each one of said heat shields secured to one of said fuel injectors; and an overlap portion on each of said heat shields axially overlapping an adjacent heat shield, whereby secondary air passing between said heat shields is deflected away from the axial direction toward the circumferential direction.

2. A combustor as in claim 1:

said swirl means establishing a common circumferential flow direction on each radial side of said plurality of fuel injectors; and said overlap portion of each heat shield overlapping the adjacent heat shield to deflect secondary air passing therebetween in the same circumferential direction as said common flow direction.

3. A combustor as in claim 2:

said overlap portion of each heat shield overlapping the adjacent heat shield only on one radial side of said plurality of fuel injectors.

4. A combustor as in claim 3:

said one radial side being the radial side contiguous with the circumference containing said ignitor.

5. A combustor as in claim 2:

said overlap portion of each heat shield overlapping the adjacent heat shield on both radial sides of said plurality of fuel injectors.

6. A combustor as in claim 4:

said circumference being the outer circumference.

* * * * *